United States Patent [19]

Wood

[11] 4,413,728

[45] * Nov. 8, 1983

[54] ARTICLE CARRIER

[75] Inventor: Prentice J. Wood, Atlanta, Ga.

[73] Assignee: The Mead Corporation, Dayton, Ohio

[ * ] Notice: The portion of the term of this patent subsequent to Feb. 12, 1997 has been disclaimed.

[21] Appl. No.: 396,345

[22] Filed: Jul. 8, 1982

[51] Int. Cl.[3] ..... B65D 6/48; B65D 75/00

[52] U.S. Cl. ..... 206/187; 229/28 BC

[58] Field of Search ..... 229/28 BC; 206/187, 206/188

[56] References Cited

U.S. PATENT DOCUMENTS

| | | | |
|---|---|---|---|
| 3,190,487 | 6/1965 | Wood | 229/28 BC |
| 3,349,957 | 10/1967 | Wood | 229/28 BC |
| 3,572,544 | 3/1971 | Farrer | 206/187 |
| 3,754,680 | 8/1973 | Wood | 206/188 |
| 3,857,483 | 12/1974 | Wood | 206/187 |
| 3,917,060 | 11/1975 | Wood | 206/187 |
| 4,117,925 | 10/1978 | Wood | 229/28 BC |
| 4,187,944 | 2/1980 | Wood | 206/187 |
| 4,258,844 | 3/1981 | Stout | 229/28 BC |

*Primary Examiner*—Herbert F. Ross

*Attorney, Agent, or Firm*—Rodgers & Rodgers

[57] ABSTRACT

An article carrier of the basket style is formed from a unitary blank and comprises a bottom wall, side walls foldably joined respectively to the side edges of the bottom wall, end wall panels foldably joined respectively to the end edges of the side walls and extending inwardly therefrom, medial partition structure foldably joined to the inner edges of the end wall panels and extending medially inward of the carrier, handle structure secured to the medial partition structure and extending upwardly therefrom, a first pair of transverse partition panels foldably joined to the medial partition structure on each side of the carrier, a second pair of transverse partition panels foldably joined respectively to the first pair of transverse partition panels on each side of the carrier and disposed in overlapping relation therewith, an anchoring tab foldably joined to each of said second pair of transverse partition panels and secured to the inner surface of the associated side wall to form a plurality of article receiving cells on each side of the carrier, the distance between the medial partition structure and the adjoining fold line between each of said first and second transverse partition panels is approximately one-fourth the width of each of said end wall panels and approximately one-third of the horizontal dimensions of the portions of the second transverse partition panels which are struck respectively from the associated first transverse partition panels.

10 Claims, 10 Drawing Figures

ARTICLE CARRIER

TECHNICAL FIELD

This invention relates to basket style article carriers which provide adequate article separation particularly near the lowermost portions of the packaged articles and which are easily manipulated and securely glued during formation thereof from a single blank.

BACKGROUND ART

Article carriers are known in which a double thickness of paperboard material is provided between all critical points of article contact in order to comply with railroad shipping regulations. An example of this type of carrier is disclosed in U.S. Pat. No. 4,187,944 issued Feb. 12, 1980 and owned by the assignee of this invention. While carriers formed according to this patent are adequate for many types of articles, this carrier is not especially adapted to provide cushioning partition structure between the lowermost portions of packaged articles such as bottles used, for example, to package beer and soft drinks.

DISCLOSURE OF THE INVENTION

According to this invention in one form, an article carrier of the basket style includes a handle secured to medial partition structure, a pair of end wall panels foldably joined to the ends of the medial partition structure, side walls secured at their end edges to the end wall panels, a bottom wall secured along its side edges to the bottom edges of the side walls, a first pair of transverse partition panels foldably joined to the medial partition structure on each side of the carrier, a second pair of transverse partition panels foldably joined respectively to said first pair of transverse partition panels on each side of the carrier and disposed in overlapping relation therewith, the distance between said medial partition structure and the adjoining fold line between each of said first and second transverse partition panels being approximately one-fourth the width of each of said end wall panels and approximately one-third of the horizontal dimension of each of said second transverse partition panels being struck from the associated one of said first transverse partition panels and the first transverse partition panel being foldably joined to the medial partition structure by a pair of very short vertically disposed and spaced apart aligned fold lines for facilitating manipulation of the carrier during formation thereof.

BEST MODE OF CARRYING OUT THE INVENTION

Figure 1:
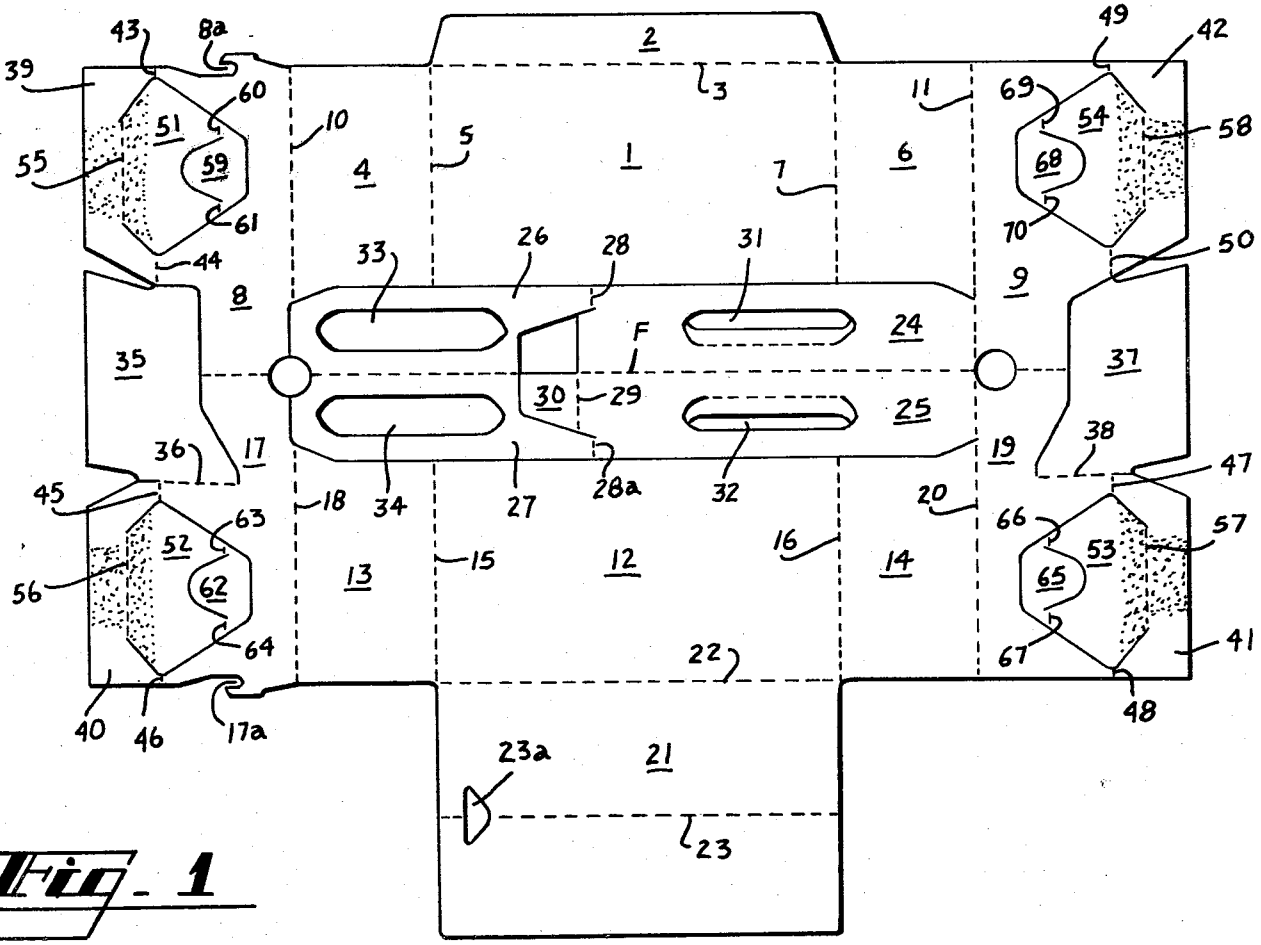
FIG. 1 is a plan view of a blank formed according to this invention.

In the drawings the numeral 1 designates a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Medial panels 8 and 9 are foldably joined to end wall panels 4 and 6 respectively along fold lines 10 and 11. Medial panel 8 is provided with locking notch 8*a*.

The other side of the blank is similar to that just described and includes side wall 12 to the side edges of which end wall panels 13 and 14 are foldably joined respectively along fold lines 15 and 16. Medial panel 17 is foldably joined to end wall panel 13 along fold line 18 and medial panel 19 is foldably joined to end wall panel 14 along fold line 20. Medial panel 17 is provided with locking notch 17*a*. Also bottom wall 21 is foldably joined to the bottom edge of side wall 12 along fold line 22 and is provided with medial fold line 23 and a locking aperture 23*a*.

Handle structure for the carrier includes handle panels 24 and 25 which are foldably joined respectively to medial panels 9 and 19 along fold lines 11 and 20. In order to provide additional strength in the area of the handle, reinforcing panels 26 and 27 are provided and are joined respectively to handle panels 24 and 25 along fold lines 28 and 28*a*. Also auxiliary flap 30 is foldably joined to handle panel 25 along fold line 29. Hand gripping apertures 31 and 32 are formed respectively in handle panels 24 and 25 and, similarly, hand gripping apertures 33 and 34 are formed respectively in reinforcing panels 26 and 27.

To provide medial article separation, medial partition structure at one end of the blank comprises medial panels 8 and 17 together with auxiliary medial partition panel 35 which is foldably joined to medial panel 17 along fold line 36. Likewise at the right hand end of the blank, as viewed in FIG. 1, the medial partition structure comprises medial panels 9 and 19 and auxiliary medial partition panel 37 which is foldably joined to medial panel 19 along fold line 38.

In order to provide individual article receiving cells, transverse partition structure is provided and includes first transverse partition panels 39, 40, 41, and 42. Transverse partition panel 39 is foldably joined along fold lines 43 and 44 to medial panel 8 and, similarly, transverse partition panel 40 is foldably joined to medial panel 17 along fold lines 45 and 46. Transverse partition panel 41 is foldably joined to medial panel 19 along fold lines 47 and 48 and transverse partition panel 42 is foldably joined to medial panel 9 along fold lines 49 and 50.

Additional transverse partition structure is provided in the form of second transverse partition panels 51, 52, 53 and 54 which are foldably joined respectively to transverse partition panels 39, 40, 41 and 42 along fold lines 55, 56, 57, and 58.

Anchoring tab 59 is foldably joined to second transverse partition panel 51 along fold lines 60 and 61 while anchoring tab 62 is foldably joined to second transverse partition panel 52 along fold lines 63 and 64. Similarly anchoring tab 65 is foldably joined along fold lines 66 and 67 to second transverse partition panel 53 and anchoring tab 68 is foldably joined to second transverse partition panel 54 along fold lines 69 and 70.

In order to form the completed carrier from the blank shown in FIG. 1, an application of glue is first made to first transverse partition panels 39, 40, 41 and 42 and to second transverse partition panels 51, 52, 53 and 54 as indicated by stippling in FIG. 1. Thereafter second transverse partition panels 51 and 52 are folded upwardly and toward the left along the fold lines 55 and 56 to occupy the positions shown in FIG. 2 while second transverse partition panels 53 and 54 are folded upwardly and to the right along fold lines 57 and 58 respectively into the positions shown in FIG. 2. Of course these folding operations cause each first transverse partition panel to become adhered to its associated second transverse partition panel and the blank then appears as shown in FIG. 2.

Figure 2:
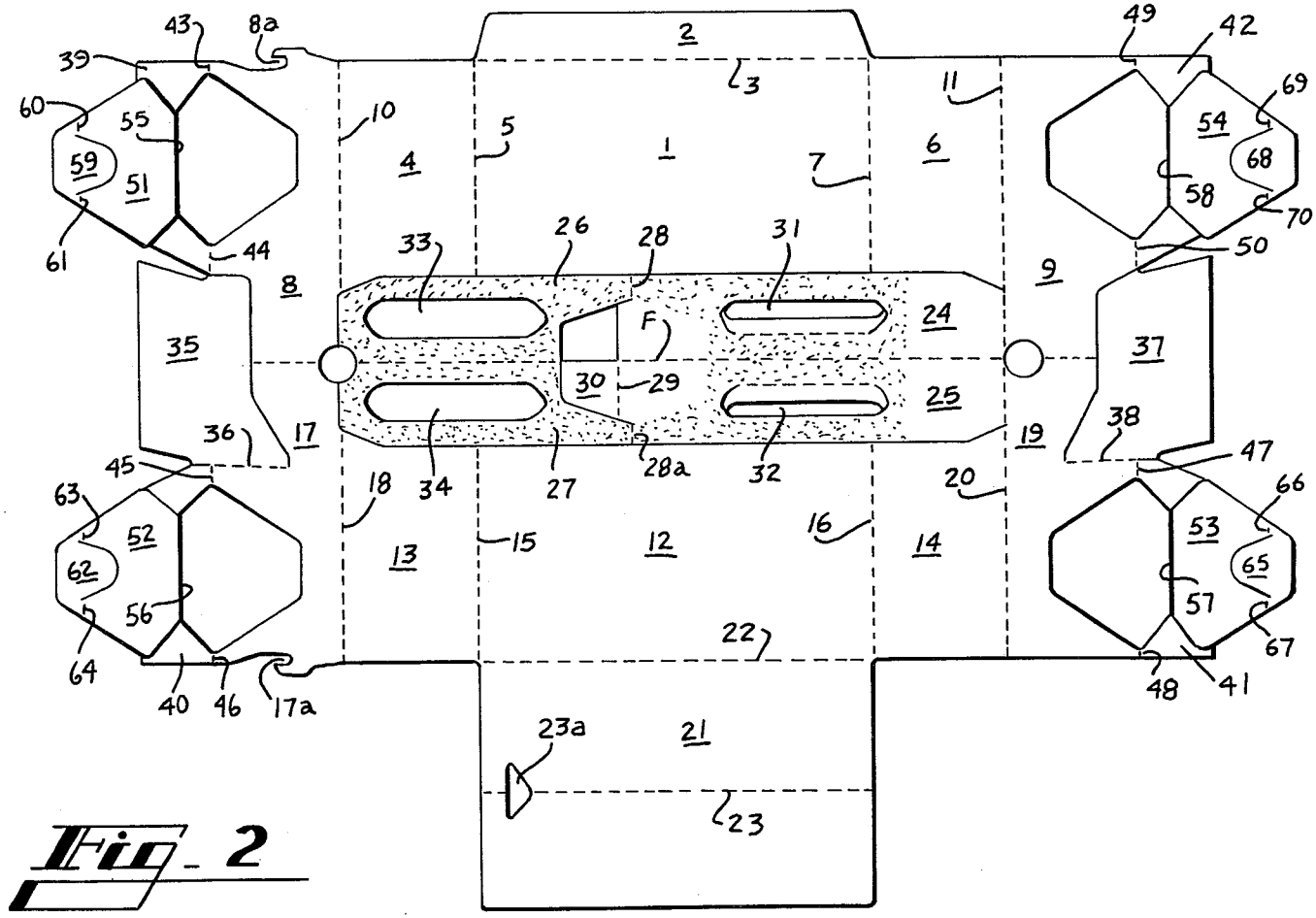
FIGS. 2–8 inclusive represent gluing and folding operations through which the blank of FIG. 1 is manipulated in order to form a collapsed completed carrier as shown in FIG. 9.

An application of glue is then made to the inner surfaces of reinforcing panels 26 and 27 and to the inner surfaces of handle panels 24 and 25 as indicated by stippling in FIG. 2. Thereafter reinforcing panels 26 and 27 are elevated and folded to the right along fold lines 28 and 29 to occupy the positions shown in FIG. 3. Of course the reinforcing panels 26 and 27 are caused to adhere to the handle panels 24 and 25 by this operation. Simultaneously first transverse partition panel 39 as well as second transverse partition panel 51 and the associated anchoring tab 59 are elevated and folded toward the right along the short vertical fold lines 43 and 44 to occupy the positions shown in FIG. 3. Also first transverse partition panel 40 and second transverse partition panel 52 along with anchoring tab 62 are elevated and folded toward the right along the short vertically disposed aligned fold lines 45 and 46 and then occupy the positions shown in FIG. 3.

Figure 3:
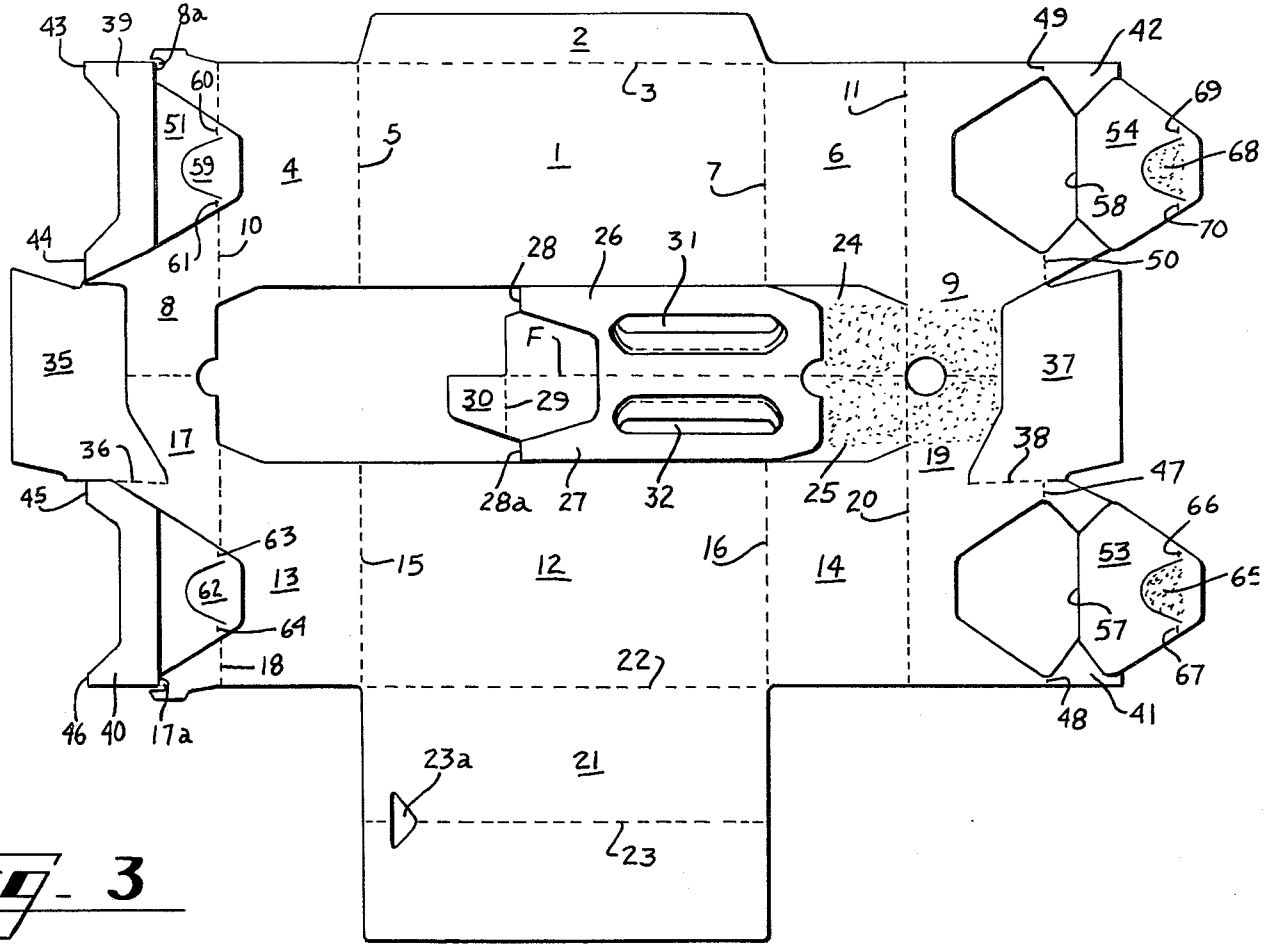

Thereafter an application of glue is made to the inner surfaces of handle panels 24 and 25 and of medial panels 9 and 19 as well as to anchoring tabs 65 and 68 as indicated by stippling in FIG. 3. Thereafter medial panels 9 and 19 together with the first and second transverse partition panels associated therewith as well as their anchoring tabs are elevated and swung toward the left along fold lines 11 and 20 to occupy the positions shown in FIG. 4. This operation causes the anchoring tab 68 to become adhered to the inner surface of side wall 1 and also causes the anchoring tab 65 to become adhered to the inner surface of side wall 12. Also medial partition panels 9 and 19 are caused to become adhered to the inner surfaces of the right hand ends of handle panels 24 and 25 and the blank then appears as shown in FIG. 4.

Figure 5:
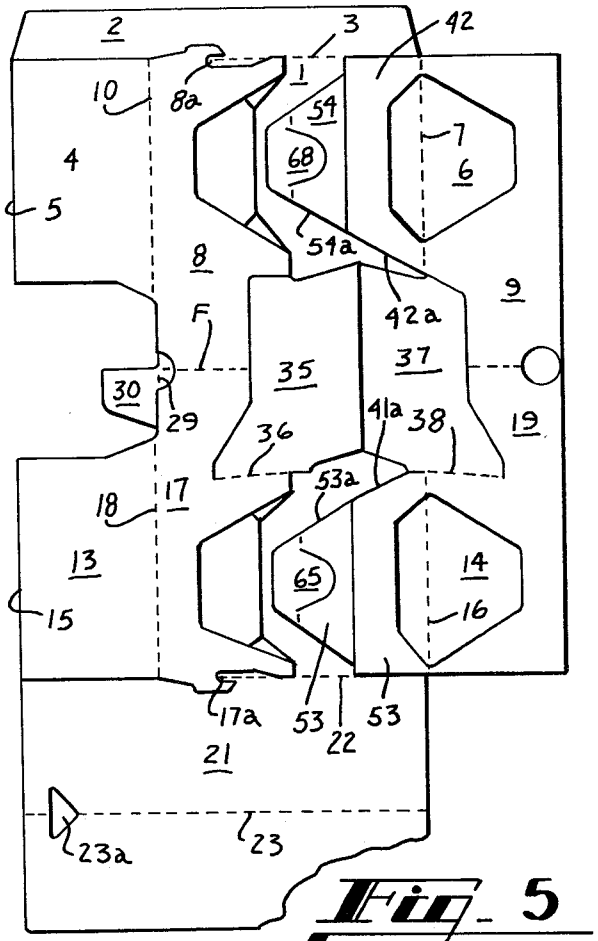
Figure 4:
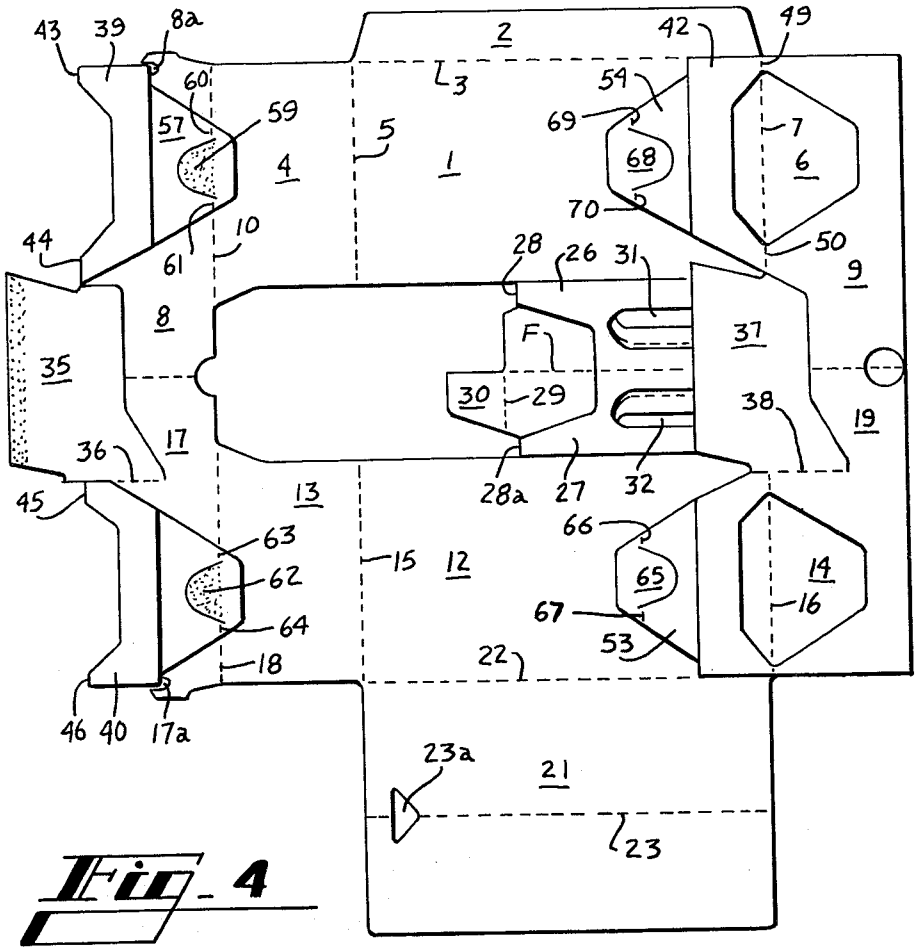

An application of glue is then made to anchoring tabs 59 and 62 as indicated by stippling in FIG. 4 as well as to the left hand edge of panel 37 and medial partition panels 8 and 17 and the first and second transverse partition panels as well as the associated anchoring tabs are elevated and folded to the right along fold lines 5 and 15 and the blank then appears as shown in FIG. 5. Of course this operation causes the anchoring tab 59 to become adhered to the inner surface of side wall 1 and also causes the anchoring tab 62 to become adhered to the inner surface of side wall 12.

Figure 6:
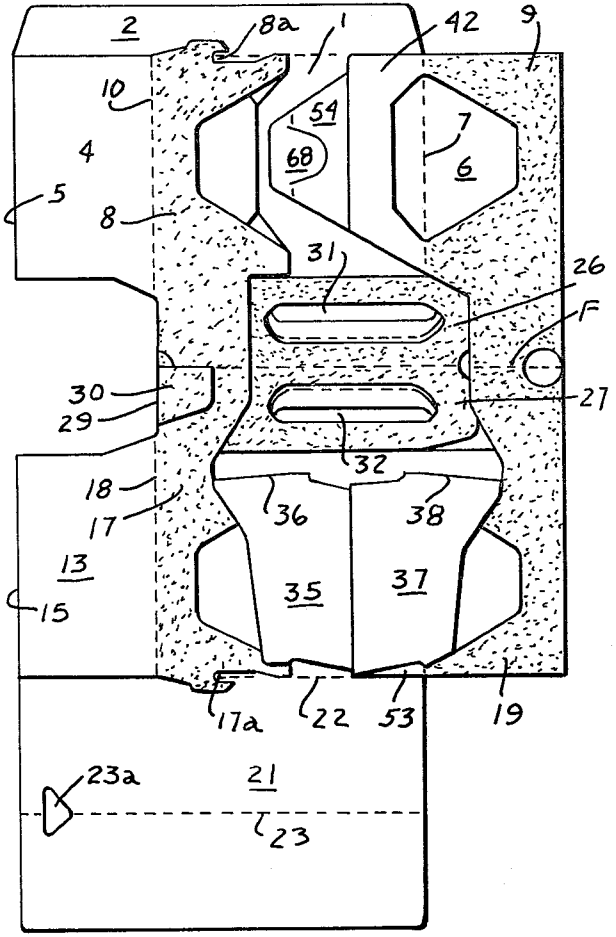

Thereafter panels 35 and 37 are folded downwardly along angularly disposed fold lines 36 and 38 to occupy the positions shown in FIG. 6. The fact that the fold lines 36 and 38 are angularly disposed causes these panels to tilt inwardly toward each other to a degree of overlap which constitutes a significant separating partition between the bottles on one side of the carrier medially thereof and the adjacent bottles on the other side of the carrier.

Figure 7:
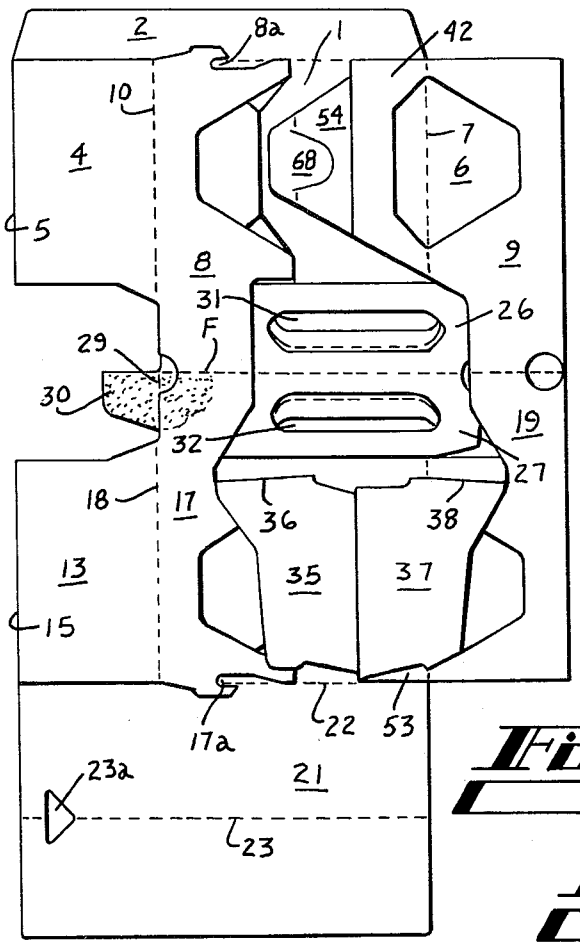

Glue is then applied to auxiliary flap 30 and to the associated medial panel 17 as indicated by stippling in FIG. 6 and the tab 30 is folded toward the right along fold line 29 to occupy the position shown in FIG. 7. Of course this tab serves as an aid in anchoring the handle structure to the medial panels.

An application of glue is then made to the blank as indicated by stippling in FIG. 7. More specifically glue is applied to medial panels 8, 17, 9 and 19 and to reinforcing panels 26 and 27 and the side wall 1 and all parts of the blank disposed above the fold line F as shown in FIG. 7 are elevated and folded forwardly and downwardly into the positions indicated in FIG. 8. Of course the stippled panels on each side of the fold line F become adhered to each other. This operation also causes the locking notch **8*a* to fall into coincidence with the locking notch 17*a***.

Figure 9:
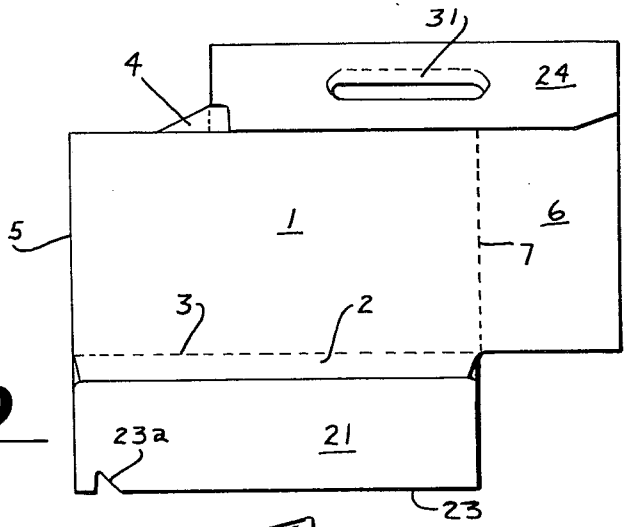
Figure 8:
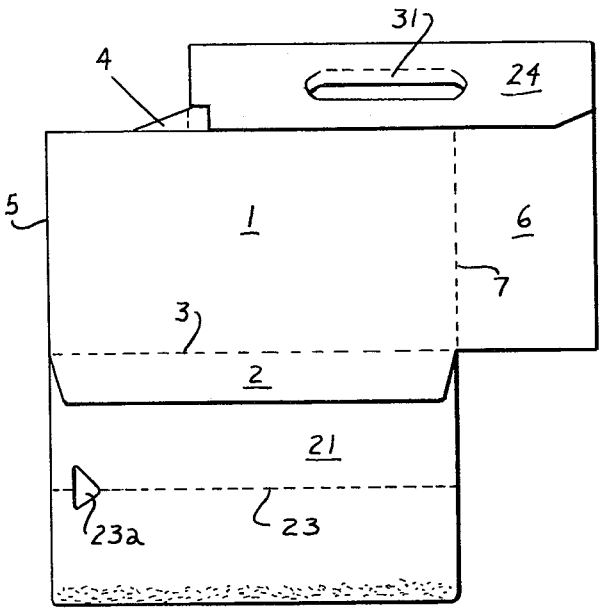

With the blank in the condition indicated in FIG. 8, an application of glue is made to an edge of bottom wall 21 which is then folded along its medial fold line 23 into the position indicated in FIG. 9. Of course this causes the bottom wall 23 to become adhered along one edge to the glue flap 2 and the completed collapsed carrier appears as shown in FIG. 9.

Figure 10:
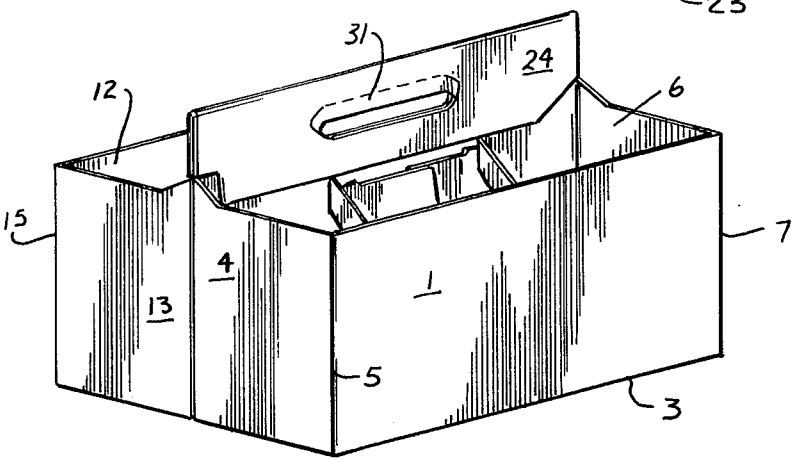
FIG. 10 shows the carrier of FIG. 1 in set up condition.

In order to set up the carrier shown collapsed in FIG. 9, it is simply necessary to hold the side walls 1 and 12 against motion toward the left while an application of force is applied to the medial structure from the right to swing the end panels 6 and 14 inwardly into set up condition while locking tabs **8*a* and 17*a* enter the locking aperture 23*a* to maintain the carrier in fully set up condition as shown in FIG. 10**.

Since the aligned vertical fold lines such as 43, 44, 45, 46, 47, 48, 49 and 50 are quite short, the manipulation of first transverse partition panels 39–42 about these fold lines is greatly facilitated. Furthermore the fact that the lowermost edges of the second transverse partition panel extend downwardly near the bottom of the carrier, it is clear that bottle separation very near to the bottom of the associated bottles is achieved according to one feature of this invention.

According to another feature of the invention, the longitudinal distance between fold line 55 between the first transverse partition panel 39 and the second transverse partition panel 51 and the aligned short fold lines 43 and 44 is approximately one-fourth of a cell size or, stated otherwise, one-fourth of the width of end wall panels such as 4, 6, 13 and 14. This same spacing between the fold line 55 and the aligned fold lines 43 and 44 also constitutes one-third of the total longitudinal or horizontal length of second transverse partition panel 51, i.e., the distance between fold line 55 and fold lines 60 and 61. Also the horizontal distance between fold line 55 and the lowermost point such as is indicated at X and the uppermost point such as is indicated at Y in FIG. 2 on the second transverse partition panel is also approximately one-fourth of the transverse dimension of a cell or one-fourth the width of an end wall panel such as panel 4. Also the horizontal distance between fold line 55 and the left hand edge of panel 39 is one-fourth the width of panel 4.

Also as is best shown in FIG. 3 the upper edge **51*a* of second transverse partition panel 51 is in downwardly inclined substantial alignment with the upper edge 39*a* of first transverse partition panel 39. This feature facilitates guiding of the bottles during loading into their proper cells. Of course the same condition of downwardly extending alignment characterizes panels 40 and 52 as indicated at 40*a* and 52*a*. Similarly edges 42*a* and 54*a* as best shown in FIG. 5 and the edge 53*a* and 41*a* as shown in FIG. 5 are in substantial downwardly inclined alignment. Furthermore as is apparent particularly in FIGS. 6 and 7, the auxiliary medial partition panels 35 and 37 are foldably joined along angularly disposed fold lines 36 and 38 respectively to cause the lower portions of panels 35 and 37** to overlap by a degree substantially greater than the overlapped upper portions of those panels thereby to provide medial separation between bottles on opposite sides of the handle.

INDUSTRIAL APPLICABILITY

By this invention an article carrier is provided which has double thickness medial and transverse partitions at all critical points particularly near the bottoms of the packaged bottles and is particularly well adapted for efficient and convenient blank manipulation during the formation of the carrier.

I claim:

1. An article carrier comprising a bottom wall, a pair of side walls foldably joined to the side edges of said bottom wall, end wall panels foldably joined respectively to the end edges of said side walls and extending inwardly therefrom, medial partition structure foldably joined to the inner edges of said end wall panels and extending medially inward of the carrier, handle structure secured to said medial partition structure and extending upwardly therefrom, a first pair of transverse partition panels foldably joined to the medial partition structure on each side of the carrier, a second pair of transverse partition panels foldably joined respectively to said first pair of transverse partition panels on each side of the carrier and disposed in overlapping relation therewith, an anchoring tab foldably joined to each of said second pair of transverse partition panels and secured to the inner surface of the associated side wall to form a plurality of article receiving cells on each side of the carrier and characterized in that the distance between said medial partition structure and the adjoining fold line between each of said first and second transverse partition panels is approximately one-fourth the width of each of said end wall panels and in that said second transverse partition panels are struck in part from the associated ones of said first transverse partition panels and of said medial partition structure and wherein the parts of said second transverse partition panels which are struck from said first transverse partition panels respectively constitute approximately one-third of the horizontal dimensions of said second transverse partition panels.

2. An article carrier according to claim 1 and further characterized in that the lower edges of said second transverse partition panels include a low point spaced horizontally from the corresponding one of said adjoining fold lines by approximately one-third the horizontal dimensions of said second transverse partition panels respectively.

3. An article carrier according to claim 2 and further characterized in that the foldable connections between said first transverse partition panels and said medial partition structure each comprises a pair of vertically disposed aligned spaced apart fold lines.

4. An article carrier according to claim 3 wherein said pairs of fold lines are of lengths which are a small percentage of the height of said medial partition structure and of said second transverse partition panels whereby folding of said first partition panel relative to said medial partition structure is facilitated.

5. An article carrier according to claim 1 and further characterized by the fact that the top edges of said first pair of transverse partition panels are downwardly and outwardly inclined.

6. An article carrier according to claim 5 and further characterized by the fact that the top edges of said second pair of transverse partition panels are downwardly and outwardly inclined.

7. An article carrier according to claim 6 and further characterized in that the top edges of said first pair of transverse partition panels are respectively substantially aligned with the top edges of the associated ones of said second pair of transverse partition panels.

8. An article carrier according to claim 1 and further characterized in that a pair of auxiliary medial partition panels are foldably joined along their top edges respectively to said medial partition structure on one side of the carrier and are disposed with their inner edges in overlapping relationship and in that said overlapping edges are secured together.

9. An article carrier according to claim 8 and further characterized in that the fold lines between said medial auxiliary partition panels are downwardly and inwardly inclined.

10. An article carrier according to claim 8 and further characterized in that the overlapping areas of said auxiliary panels are wider at the lower portions of said auxiliary panels than at the upper portions thereof.

* * * * *